US006843641B1

(12) United States Patent
Scharfenberg

(10) Patent No.: US 6,843,641 B1
(45) Date of Patent: Jan. 18, 2005

(54) RADIAL PISTON PUMP

(75) Inventor: Andreas Scharfenberg, Murrhardt (DE)

(73) Assignee: Robert Bosch GmbH, Stuttgart (DE)

( * ) Notice: Subject to any disclaimer, the term of this patent is extended or adjusted under 35 U.S.C. 154(b) by 148 days.

(21) Appl. No.: 10/148,964

(22) PCT Filed: Nov. 9, 2000

(86) PCT No.: PCT/DE00/03914

§ 371 (c)(1),
(2), (4) Date: Aug. 28, 2002

(87) PCT Pub. No.: WO01/42651

PCT Pub. Date: Jun. 14, 2001

(30) Foreign Application Priority Data

Dec. 8, 1999 (DE) ..... 199 59 006

(51) Int. Cl.[7] ..... F04B 1/04; F04B 39/10; F04B 39/08

(52) U.S. Cl. ..... 417/273; 417/490; 417/493; 417/505

(58) Field of Search ..... 417/273, 298, 417/311, 415, 443, 490, 491, 493, 494, 499, 505, 521

(56) References Cited

U.S. PATENT DOCUMENTS 2,336,526 A * 12/1943 Bristol ..... 417/297.5
3,709,639 A * 1/1973 Suda et al. ..... 417/493
4,538,580 A * 9/1985 Straubel et al. ..... 123/494
4,777,921 A 10/1988 Fujisawa et al.
5,156,531 A * 10/1992 Schmid et al. ..... 417/295
5,167,493 A * 12/1992 Kobari ..... 417/273
5,697,343 A 12/1997 Isozumi et al.
5,701,873 A 12/1997 Schneider

FOREIGN PATENT DOCUMENTS

DE 197 09 586 A 9/1998
DE WO 99 02857 A 1/1999

* cited by examiner

*Primary Examiner*—Justine R. Yu
*Assistant Examiner*—Timothy P. Solak
(74) *Attorney, Agent, or Firm*—Ronald E. Greigg

(57) ABSTRACT

A radial piston pump for generating high fuel pressure in common rail fuel injection systems of internal combustion engines having a drive shaft which is rotatably supported in a pump housing and is embodied eccentrically, and having a plurality of pistons, in particular three, each disposed in a respective element bore radially relative to the drive shaft, which are movable radially back and forth in the respective element bore by rotation of the drive shaft and each define one cylinder chamber, which communicates via a suction valve with a low-pressure chamber. Precisely one suction valve is controlled such that it opens and closes as a function of the angle of rotation of the drive shaft.

6 Claims, 4 Drawing Sheets

RADIAL PISTON PUMP

CROSS-REFERENCE TO RELATED APPLICATIONS

This application is a 35 USC 371 application of PCT/DE 00/03914 filed on Nov. 9, 2000.

BACKGROUND OF THE INVENTION

1. Field of the Invention

2. Description of the Prior Art

Th invention relates to a radial piston pump for generating high fuel pressure in fuel injection systems of internal combustion engines, in particular in a common rail injection system, having a drive shaft, which is rotatably supported in a pump housing and is embodied eccentrically, and having a plurality of pistons, in particular three, each disposed in a respective element bore radially relative to the drive shaft, which are movable radially back and forth in the respective element bore by rotation of the drive shaft and each define one cylinder chamber, which communicates via a suction valve with a low-pressure chamber.

In common rail injection systems, a high-pressure pump, with the aid of a prefeed pump, pumps the fuel to be injected out of a fuel tank into a central high-pressure fuel reservoir, also called a common rail. From the rail, fuel lines lead to the individual injectors, which are assigned to the cylinders of the engine. The injectors are triggered individually by the engine electronics, as a function of the engine operating parameters, in order to inject fuel into the combustion chamber of the engine.

As the high-pressure pump, a radial piston pump can be used, of the kind described for instance in German Patent Application DE 198 48 035, which had not yet been published by the priority date of the present application. In such a radial piston pump, one piston with the associated cylinder chamber each form one pump element, by which the pumped fuel is subjected to high pressure. The pumping quantity of the radial piston pump can be adapted to the demand of the engine at the time with the aid of a metering unit. Then only as much fuel as is actually used is compressed in the radial piston pump. As the metering unit, an adjustable throttle provided on the intake side of the radial piston pump can be employed. As a consequence, in operation with a small pumping quantity, the individual cylinder chambers are incompletely filled. An equivalent of DE 198 48 035 has now issued as U.S. Pat. No. 6,457,957, the disclosure of which is hereby incorporated by reference.

To seal off the individual cylinder chambers from the low-pressure chamber, suction valves prestressed by a closing spring can be used. In practice, different suction valves of the same model have different prestressing, for reasons dictated by their manufacture. Accordingly the opening pressures of the various suction valves also differ. As a consequence, different structurally identical suction valves of the same radial piston pump are opened for different lengths of time, especially at minimal pumping, as a function of the prestressing of the respective closing spring. In an extreme case, it can happen that a suction valve will not open at all. Hence the corresponding cylinder chamber is filled only inadequately if at all in the intake stroke. This results in uneven pumping of the various pump elements. This in turn can cause rough operation of the engine, which is especially unwanted in passenger cars.

In DE 198 48 035, which had not yet been published by the priority date of the present application, it is proposed that uniform pumping of the various pump elements be improved by bracing the closing springs of all the suction valves on the associated pistons. As a result, opening of the suction valves is controlled as a function of the piston position. If one piston is moving toward the associated suction valve, then an increasing force is exerted by the closing spring on the valve body of the suction valve. This assures that the suction valve is closed if the associated piston is at its top dead center. When the piston moves away from the suction valve, the force exerted by the closing spring on the valve body of the suction valve drops. It is thus assured that the suction valve is open when the associated piston is at bottom dead center. However, the embodiment described in DE 198 48 035 has the disadvantage of being relatively complicated and expensive to make.

The primary object of the invention is therefore to furnish a radial piston pump which assures uniform pumping of the various pump elements and which can be produced economically.

In a radial piston pump for generating high fuel pressure in fuel injection systems of internal combustion engines, in particular in a common rail injection system, having a drive shaft, which is rotatably supported in a pump housing and is embodied eccentrically, and having a plurality of pistons, in particular three, each disposed in a respective element bore radially relative to the drive shaft, which are movable radially back and forth in the respective element bore by rotation of the drive shaft and each define one cylinder chamber, which communicates via a suction valve with a low-pressure chamber, this object is attained in that precisely one suction valve is controlled such that it opens and closes as a function of the angle of rotation of the drive shaft.

SUMMARY OF THE INVENTION

The use of only one controlled suction valve has the advantage that a controlled suction valve need not be used for each pump element. As a result, the production costs for the radial piston pump and the effort of setting the suction valves can be reduced markedly.

A particular embodiment of the invention is characterized in that the controlled suction valve has a valve body which is acted upon by a closing spring that is braced on the associated piston. As a function of the position of the associated piston and thus of the drive shaft, the closing spring presses against the valve body of the suction valve. When the piston is at its top dead center, the distance between the piston and the valve body is the least. Accordingly, the force exerted by the closing spring on the valve body is then greatest.

A further particular embodiment of the invention is characterized in that the controlled suction valve is controllable, for instance via a magnet, such that it opens at top dead center of the associated piston and closes again a certain angle of rotation of the drive shaft later. Because of the precisely defined opening duration of the controlled suction valve, the uniform pumping of the radial piston pump of the invention is improved.

Another particular embodiment of the invention is characterized in that the other suction valves are designed such that they open independently of the angle of rotation of the drive shaft, at different opening pressures. The other, uncontrolled suction valves open as a function of the prevailing pressure difference. Because of the different opening pressures, it is assured that each suction valve will open, even at minimal pumping. Accordingly all the pump elements pump fuel. Nevertheless, the opening times of individual suction valves are different. Hence not every element feeds the same amount of fuel. Nevertheless, good results have been obtained in practice with the radial piston pump of the invention.

BRIEF DESCRIPTION OF THE DRAWINGS

Further advantages, characteristics and details of the invention will become apparent from the ensuing description, in which two exemplary embodiments of the invention are described in detail, in conjunction with the drawings in which FIG. 1, the plotting of the piston strokes over the time as a function of the position of the suction valves, in a first embodiment of the invention.

DESCRIPTION OF THE PREFERRED EMBODIMENTS

The radial piston pump of the invention includes three pump elements, offset by 120° from one another in a radial plane to the axis of a drive shaft. The drive shaft is supported rotatably in a pump housing and is equipped with an eccentric shaft segment. The eccentric shaft segment of the drive shaft cooperates with three pistons, which are each disposed in a respective element bore radially to the drive shaft. Each of the pistons defines one cylinder chamber. Via a suction valve, fuel enters the cylinder chamber, where it is subjected to high pressure by the piston. The fuel subjected to high pressure passes via a pressure valve into a high-pressure fuel reservoir (rail).

The radial piston pump of the invention accordingly includes three suction valves and three pressure valves. In a first embodiment of the invention, two conventional, spring-prestressed suction valves are used together with one suction valve controlled as a function of the angle of rotation, the closing spring of this last suction valve being braced against the associated piston. The term "controlled as a function of angle of rotation" means that the suction valve is controlled as a function of the angle of rotation of the drive shaft. The control of the suction valve is effected through the closing spring, which as a function of the position of the associated piston exerts a more or less major force on the suction valve. Such a suction valve is described for instance in DE 198 48 035, which had not yet been published by the priority date of the present application.

Figure 1:
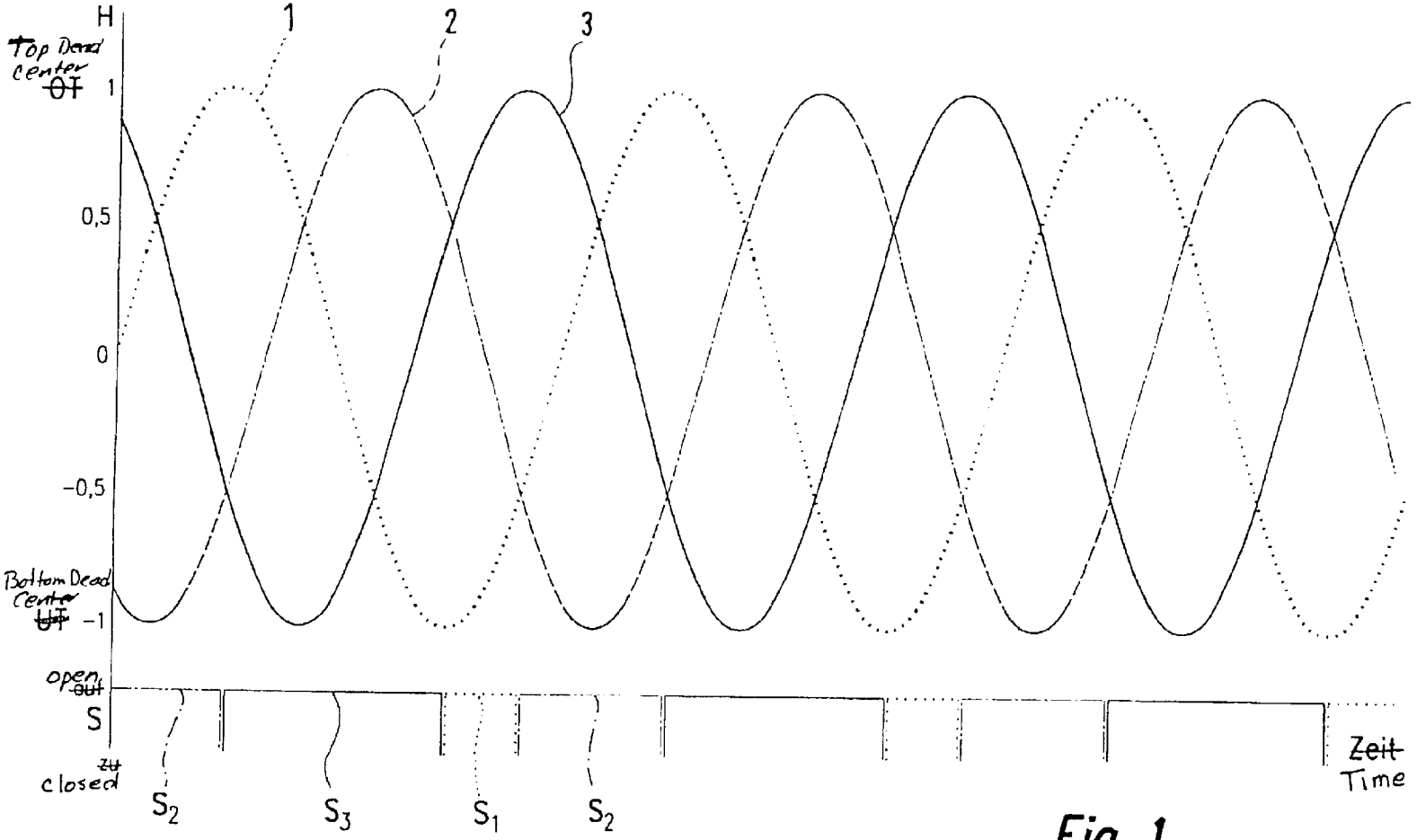

In FIG. 1, the piston strokes H of the three pump elements 1, 2 and 3 are plotted over time as a function of the position of the associated suction valves $S_1$, $S_2$ and $S_3$. The suction valve $S_2$ is controlled as a function of angle of rotation. If the piston 2 assigned to the pump element 2 is in the vicinity of bottom dead center, then the suction valve $S_2$ opens. In the upward motion of the piston 2, the closing spring braced on the piston is compressed, causing the suction valve $S_2$ to close. In the low-pressure chamber (not shown), which in conventional radial piston pumps is formed by an annular conduit, inlet pressure continues to prevail. The inlet pressure assures that the uncontrolled suction valve $S_3$ will open. For that purpose, the opening pressure at the suction valve $S_3$ must be set no higher than at the suction valve $S_2$. The suction valve $S_3$ remains open until such time as the pump element 3 has filled to such an extent that the higher opening pressure of the suction valve $S_1$, is reached. Then the uncontrolled suction valve $S_1$, opens, until such time as the controlled suction valve $S_2$, has opened again.

By the combination, according to the invention, of one controlled an two uncontrolled suction valves, it is assured that in operation of the radial piston pump, even at minimal pumping, each suction valve is opened and thus all three pump elements pump fuel. However, in the principle according to the invention, not every pump element pumps the same quantity of fuel, since the opening times of the suction valves are of different lengths, as can be seen from FIG. 1.

Figure 2:
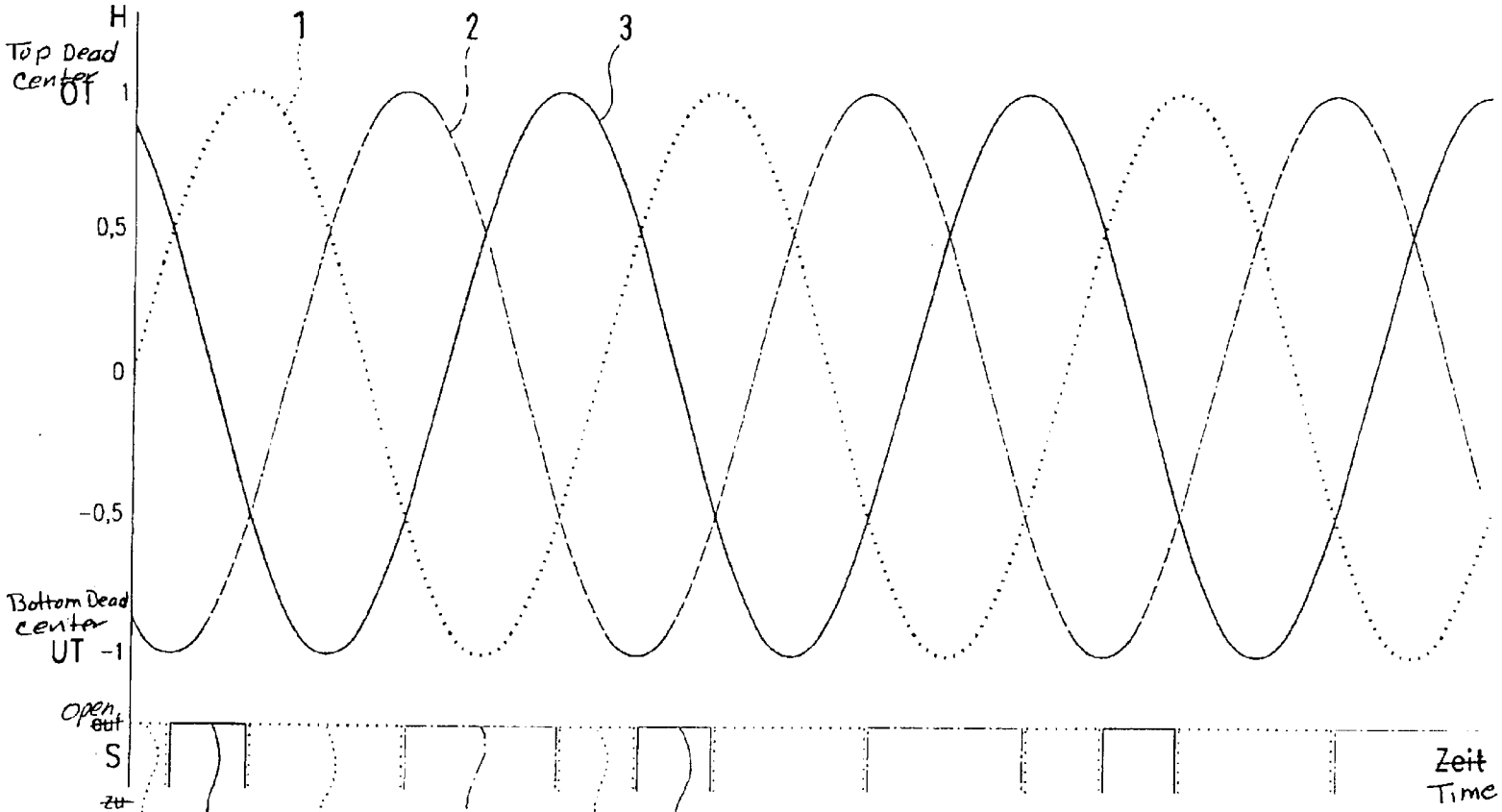
FIG. 2, the plotting of the piston strokes over the time as a function of the position of the suction valves, in a second embodiment of the invention.
Figure 3:
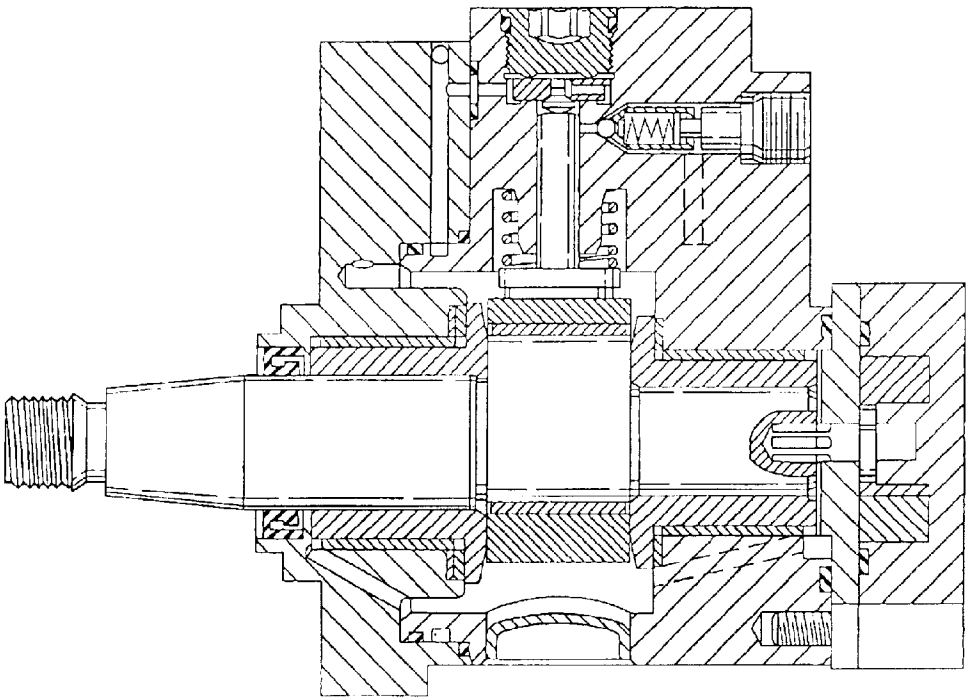
FIG. 3 PRIOR ART
FIG. 3 is a showing of prior art which indicates the structure to which this invention is applied.
Figure 4:
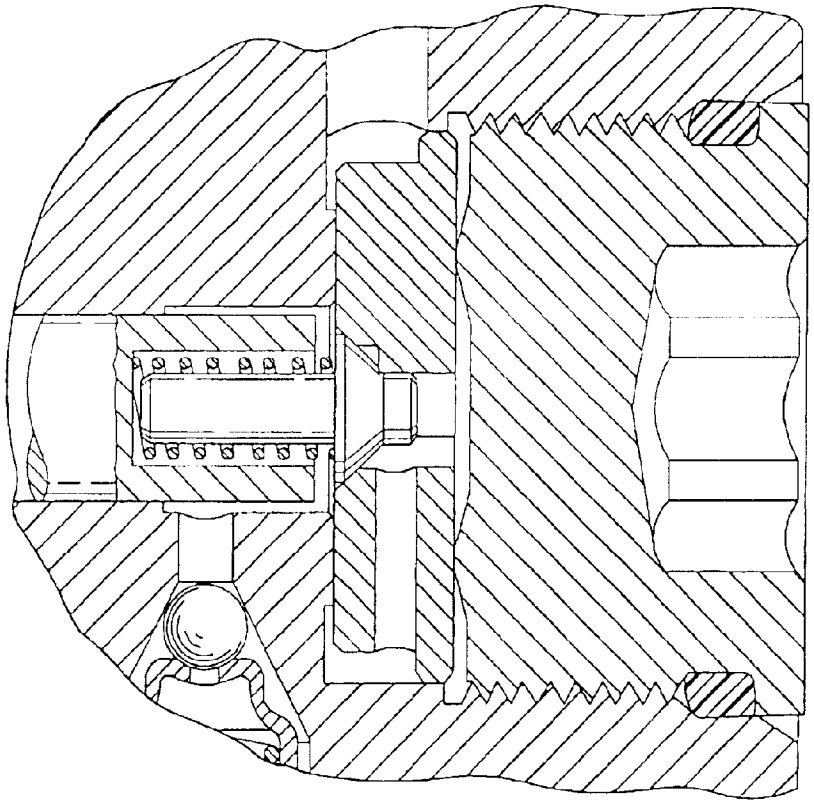
FIG. 4 PRIOR ART
FIG. 4 is a showing of prior art which indicates the structure to which this invention is applied, and is an enlarged detail II from FIG. 3.

Even better uniform pumping can be achieved with a separately, for instance magnetically, controlled suction valve. In FIG. 2, an embodiment of the invention with two conventional suction valves $S_1$, $S_3$ and one separately controlled suction valve $S_2$ is shown. The suction valve $S_2$ is controlled such that it opens at top dead center OT of the pump element 2 and closes again later, at a lesser pumping quantity, at an angle of rotation of the drive shaft of 120°. As a result of the applied inlet pressure, the suction valve $S_1$ thereupon opens, whose opening pressure is set to be lower than that of the suction valve $S_3$. In the pump element 1 that then fills as a result, the piston, by its reciprocating motion, forces the fuel toward the suction valve $S_1$, which is closed thereby. By the pressure prevailing in the low-pressure chamber, the suction valve. $S_3$ is then opened, and remains open until such time as the piston in the pump element 1 has left top dead center again, as a result of which the suction valve $S_1$, because of its lesser opening pressure, opens again. The suction valve $S_1$ remains open until such time as the controlled suction valve $S_2$ opens again.

By the combination according to the invention of the separately controlled suction valve $S_2$ with the uncontrolled suction valves $S_1$ and $S_3$, it is assured that all three pump elements 1–3 will reliably be filled with fuel. By means of the controlled opening duration of the suction valve $S_2$ of an angle of rotation of 120°, better uniform pumping than in the embodiment shown in FIG. 1 can be expected. The control for the separate suction valve $S_2$ is integrated into the radial piston pump.

The invention offers the advantage in general that the opening pressure of the uncontrolled suction valves can be lowered. As a result, the starting conditions for the prefeed pump in a common rail injection system are additionally made easier. Moreover, the efficiency can be increased compared to a radial piston pump with three controlled suction valves.

The forgoing relates to preferred exemplary embodiments of the invention, it being understood that other variants and embodiments thereof are possible within the spirit and scope of the invention, the latter being defined by the appended claims.

I claim:

1. A radial piston pump for generating high fuel pressure in a common rail fuel injection systems of an internal combustion engines, comprising, a pump housing having three element bores therein a drive shaft rotatably supported in said pump housing and embodied eccentrically, and three pistons each disposed in a respective element bore radially relative to the drive shaft, the pistons being movable radially back and forth in the respective element bore by rotation of the drive shaft and each define one cylinder chamber, which communicates via a suction valve ($S_1$, $S_2$, $S_3$) with a low-pressure chamber, precisely one suction valve ($S_2$) being controlled such that it opens and closes as a function of an angle of rotation of the drive shaft.

2. The radial piston pump of claim 1, wherein the one controlled suction valve ($S_2$) has a valve body which is acted upon by a closing spring that is braced on the associated piston.

3. The radial piston pump of claim 1, wherein the other suction valves ($S_1$, $S_3$) are designed such that they open independently of the angle of rotation of the drive shaft, at different opening pressures.

4. The radial piston pump of claim 1, the one controlled suction valve ($S_2$) is controllable, via a magnet, such that it opens at top dead center of the associated piston and closes again a certain angle of rotation of the drive shaft later.

5. The radial piston pump of claim 2, wherein the other suction valves ($S_1$, $S_3$) are designed such that they open independently of the angle of rotation of the drive shaft, at different opening pressures.

6. The radial piston pump of claim 1, wherein the other suction valves ($S_1$, $S_3$) are designed such that they open independently of the angle of rotation of the drive shaft, at different opening pressures.

* * * * *

UNITED STATES PATENT AND TRADEMARK OFFICE

CERTIFICATE OF CORRECTION

PATENT NO. : 6,843,641 B1
DATED : January 18, 2005
INVENTOR(S) : Andreas Scharfenberg It is certified that error appears in the above-identified patent and that said Letters Patent is hereby corrected as shown below:

Title page,
Item [56], should read as follows:
-- [56] References Cited
FOREIGN PATENT DOCUMENTS
DE 197 09 586 A 9/1998
WO 99 02857 A 1/1999 --

Signed and Sealed this

Fifth Day of April, 2005

JON W. DUDAS
*Director of the United States Patent and Trademark Office*